United States Patent [19]

Storey et al.

[11] Patent Number: 4,667,561

[45] Date of Patent: May 26, 1987

[54] MANUAL STRING LOCK WITH ADJUSTABLE LOCKING ACTION

[76] Inventors: David C. Storey, 13801 Gershon Pl., Santa Ana, Calif. 92705; David J. Petschulat, 200 W. Union, Apt. #2, Fullerton, Calif. 92632

[21] Appl. No.: 872,285

[22] Filed: Jun. 10, 1986

[51] Int. Cl.[4] ..... G10D 3/12

[52] U.S. Cl. ..... 84/314 N

[58] Field of Search ..... 84/298, 299, 314

[56] References Cited

U.S. PATENT DOCUMENTS

| | | | |
|---|---|---|---|
| 118,353 | 8/1871 | Faas | 84/214 |
| D. 280,330 | 8/1885 | Tanaka et al. | D17/20 |
| 550,268 | 11/1895 | Hafer et al. | 84/214 |
| 617,915 | 1/1899 | Wells | 84/297 R |
| 1,331,203 | 2/1920 | Knapp | 24/134 R |
| 3,093,220 | 6/1963 | Modrey | 189/36 |
| 4,149,443 | 4/1979 | Bringe | 84/318 |
| 4,171,661 | 10/1979 | Rose | 84/313 |
| 4,457,201 | 7/1984 | Storey | 84/313 |
| 4,475,432 | 10/1984 | Stroh | 84/314 N |
| 4,517,874 | 5/1985 | Fender | 84/314 N |
| 4,574,678 | 3/1986 | Edwards | 84/314 N |
| 4,579,033 | 4/1986 | Edwards | 84/314 N |

*Primary Examiner*—Lawrence R. Franklin

*Attorney, Agent, or Firm*—Laubscher & Laubscher

[57] ABSTRACT

A manual string lock for clamping the strings of a musical instrument adjacent the nut is disclosed. The string lock includes an adjustable clamping mechanism for accommodating strings of different diameters. A unique cam-shaped lever and wedge combination is provided to lock and release the strings. The levers are rotatably connected with the string lock base for rotation about a horizontally and longitudinally offset axis. The cam surface of each lever abuts against a corresponding wedge. Manual rotation of the levers to an overcenter position displaces the wedges longitudinally which in turn vertically displaces the clamping screw and block assemblies, whereby the strings of the instrument are clamped between the clamping blocks and the string lock base.

10 Claims, 3 Drawing Figures

MANUAL STRING LOCK WITH ADJUSTABLE LOCKING ACTION

BACKGROUND OF THE INVENTION

The present invention relates to an improved string locking device for clamping the strings of a musical instrument. The device is preferably mounted behind the nut of the musical instrument and includes a plurality of manually operable levers for actuating and releasing a string clamping mechanism without the need for any tools.

BRIEF DESCRIPTION OF THE PRIOR ART

String locking or clamping devices are well-known in the patented prior art as evidenced by the patents to Rose; U.S. Pat. No. 4,171,661, Storey; U.S. Pat. No. 4,457,201, and Stroh; U.S. Pat. No. 4,475,432.

The Rose patent, for example, discloses a string locking nut for guitars including a base element containing a plurality of slots for receiving the strings of the instrument. Clamping blocks are connected with the base element by screws or bolts, and a screwdriver or wrench is required to tighten the screws or bolts in order to clamp the strings between the clamping blocks and the base element.

The Stroh patent also discloses a string clamp at the nut of a musical instrument such as a guitar. The clamp includes a base element adapted to receive a plurality of clamping blocks each containing an aligned opening. One end block contains a threaded opening and a bolt passes through the aligned openings of the blocks and is threadably connected with the threaded end block. The strings of the instrument are arranged between adjacent blocks, and tightening of the bolt with an Allen wrench clamps the strings between the clamping blocks.

The Storey patent discloses a string securing device mounted on the neck of a string instrument behind the nut. The instrument strings pass between a base element and a clamping plate. A screw-operated cross member rotatably connected with the base element is operable to clamp and release the instrument strings.

While the prior devices normally operate satisfactorily, they are all rather cumbersome to operate, usually requiring a tool to provide sufficient clamping force. Moreover, those prior string locks which comprise the nut of the instrument must be designed for specific spacing between the strings, thereby dictating the string spacing to the instrument player. Furthermore, the nut mount string locks require a set arc of the strings across the width of the finger board. Thus, string locks of different designs are needed for different guitars and different players.

The present invention was developed in order to overcome these and other drawbacks of the prior devices by providing an adjustable string clamping mechanism which is quickly and easily manually operated to securely clamping the strings of a musical instrument. The string clamp of the present invention is mounted behind the nut and thus may be used on a variety of instruments by different players. Since the original instrument nut is retained, no special modification to the instrument is required in order to mount the string clamp. Furthermore, the original tone of the instrument is retained by retaining the original nut.

SUMMARY OF THE INVENTION

According to a primary object of the invention, the string clamping apparatus includes a base connected with the head portion of a stringed musical instrument. The base contains a plurality of first and second recesses in the top and bottom surfaces thereof, the bottom walls of the top recesses being inclined from the rear to the front of the base. The base also contains a plurality of first through-openings communicating with the second recesses with the instrument strings passing therethrough, and a plurality of second through-openings extending between the first and second recesses, respectively. A plurality of clamping blocks are arranged in the second recesses with the strings passing between the blocks and the recess bottom wall. Each block contains a threaded opening aligned with one of the second through-openings in the base. A plurality of wedges are arranged in the first recesses, each wedge having an inclined bottom surface corresponding and in sliding engagement with one of the first recess bottom walls. Each wedge also contains an oval through-opening aligned with one of the second through-openings. A plurality of screws are arranged in the wedge openings and the second through-openings and are threadably connected with the clamping block threaded openings, respectively. When the wedges are longitudinally displaced along the base inclined surface, the screws and clamping blocks are vertically displaced to clamp and release the strings within the second recesses.

According to a more specific object of the invention, a plurality of levers are arranged within the first recesses and rotatably connected with the base. The levers each contain a cam surface which abuts against one of the wedges and rotates about a longitudinally and horizontally offset axis to provide camming action against the wedges. More particularly, the levers rotate through and are locked in an over-center position with the cam surfaces engaging the wedges to clamp the instrument strings.

DETAILED DESCRIPTION

Figure 1:
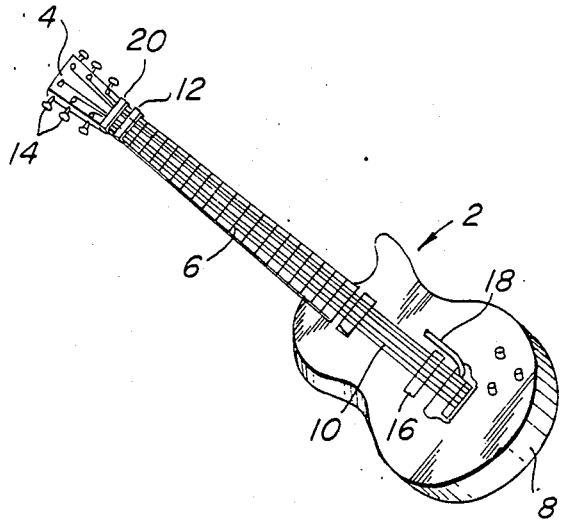
FIG. 1 is a perspective view of a guitar including the adjustable manual string lock according to the invention.

Although the manual string lock of the invention is suitable for use with a variety of stringed musical instruments, it will be described in connection with a guitar. As shown in FIG. 1, the guitar 2 includes head 4, neck 6, and body 8 with strings 10 extending between the head and body portions across the neck. The guitar includes a nut 12 generally arranged at the intersection of the head and neck portions for supporting the strings. A plurality of tuning pegs 14 at the head of the guitar are operable to tune the strings, and a bridge 16 is mounted on the body portion to define with the nut the playing area of the strings. A tremolo device 18 may be connected with the strings adjacent or in combination with the bridge to produce a vibrato effect within the guitar strings. The string lock 20 of the present invention is preferably connected with the head of the guitar behind the nut 12 as shown in FIGS. 1 and 2.

Figure 2:
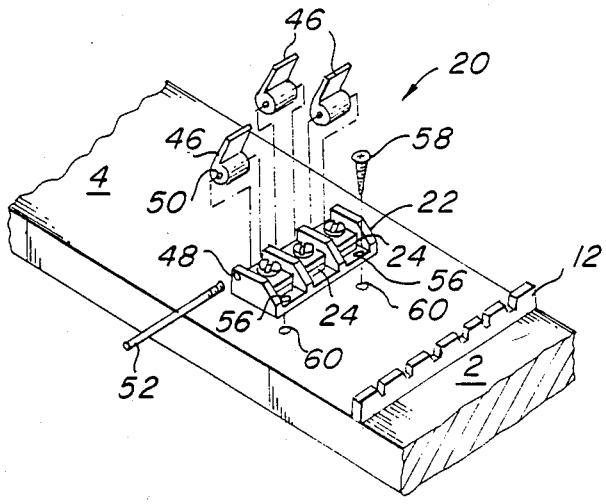
FIG. 2 is a detailed exploded view of the string lock.
Figure 3:
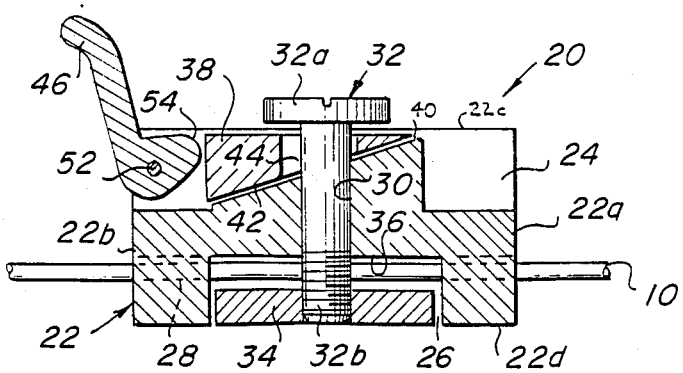
FIG. 3 is a sectional side view of the string lock.

The manual string lock 20 according to the invention is shown more particularly in FIGS. 2 and 3. The string lock includes a base 22 having front 22*a*, rear 22*b*, top 22*c*, and bottom 22*d* surfaces, with the front surface facing the instrument nut 12 and the rear surface facing the tuning pegs. For a six-string guitar, the base contains three spaced, parallel recesses 24 in the top surface thereof and three corresponding spaced, parallel recesses 26 in the bottom surface thereof. As will be developed in greater detail below, the three pairs of corresponding top and bottom recesses each accomodate two of the instrument strings, one of which is shown in FIG. 3.

More particularly, the string lock base 22 contains a plurality of first longitudinal through-openings 28 which extend between the rear and front surfaces of the base, with two of the first through-openings communicating with each of the bottom recesses 26. As shown in FIG. 3, the instrument strings pass through the openings 28 with a portion of the string passing through the corresponding bottom recess 26.

The string lock base 22 also contains a plurality of second through-openings 30 which extend vertically between the top and bottom recesses. A plurality of screws 32 having head 32*a* and body 32*b* portions are arranged with their body portions passing through the second openings 30 in the base.

A clamping block 34 is arranged in each of the bottom recesses 26 and contains a threaded opening aligned with one of the second openings 30 in the base. The screw body portion 32*b* of each screw is threadably connected with the threaded opening in the corresponding clamping block. As shown in FIG. 3, portion of the string 18 which passes through the bottom recesses of the base is arranged between the clamping block 34 and the wall 36 of the base which defines the top of the bottom recess. Each screw head portion is knurled at its outer surface and contains a slot. Rotation of each screw vertically displaces the associated clamping block to adjust the space between the block and the body member bottom wall through which an instrument string passes. In this manner, the spacing of the clamping blocks may be adjusted to accomodate a variety of strings of different diameters without unduly damaging the strings.

A wedge device 38 is arranged in each of the top recesses 24. Each recess is defined by a bottom wall 40 which is inclined from the rear surface 22*b* to the front surface 22*a* of the base. Similarly, each wedge has a bottom wall 42 which is also inclined from the rear to the front thereof and which corresponds with the inclination of the base recess wall 40. Each wedge 38 rests on the base recess wall 40 and is adapted to slide horizontally and longitudinally relative thereto. Each wedge contains an oval shaped opening 44 which is generally aligned with the second opening 30 in the base. The screw body portions 32*b* pass through the wedge openings 44 and the screw head portions 32*a* have a diameter greater than the minimum diameter of the wedge openings 44, whereby the screw head portion rests on the top surface of the wedges. The oval openings 44 thus allow the wedges to be horizontally displaced while the screws remain horizontally stationary. As each wedge is displaced toward the front surface 22*a* of the base, it raises the associated screw 32 to raise the clamping block 34 to clamp the instrument strings within the corresponding bottom recess 26. When a wedge is in its forward clamping position, it is difficult to rotate the screw 22 by hand. However, the screw may be turned by a screwdriver which engages the slot in the screw head portion 32*a* to adjust the clamping of the strings while the wedge is in its clamping position.

A lever 46 is also mounted in each top recess 24 behind each wedge 38. More particularly, the base contains a plurality of aligned third through-openings extending laterally between opposite sides of the base and each lever contains an opening 50 aligned with the third openings 48 in the base. A pin 52 passes through the aligned lever and base third openings, whereby the levers are rotatably connected with the base.

The openings 50 in each lever 46 are horizontally and longitudinally offset from the lateral center of gravity of the levers to provide camming action upon rotation thereof. Moreover, each lever includes a cam surface 54 which is operable to engage the rear of the adjacent wedge 38. As a lever is manually rotated forwardly—i.e. in the clockwise direction of FIG. 3—the cam surface 54 thereof engages and pushes the adjacent wedge forwardly toward its clamping position as set forth above. Further, rotation of the lever to an overcenter position serves to lock the wedge in its clamping position. A slight lifting force applied by a player's finger to the end of the lever releases the lever from its overcenter position and the wedge is displaced away from its clamping position to release the corresponding clamping block.

Accordingly, the strings of a musical instrument may be quickly locked and released by the player of the instrument without the necessity for any tools.

The string lock 20 may be secured to the instrument behind the nut by any suitable devices. For example, a plurality of fourth vertical through-openings 56 are provided in the base 22 for receiving mounting screws 58 which are threaded into openings 60 in the head portion 4 of the guitar.

The string lock is preferably formed of a high quality metal such as brass, although other materials having high strength and wear-resistance may also be used.

While in accordance with the provisions of the patent statute the preferred forms and embodiments of the invention have been illustrated and described, it will be apparent to those skilled in the art that various changes and modifications may be made without deviating from the inventive concepts set forth above.

What is claimed is:

1. Apparatus for clamping the strings of a musical instrument adjacent the nut at the head portion of the instrument, comprising (a) a base having front, rear, top, and bottom surfaces, said base containing (1) a plurality of spaced, parallel first recesses in said top surface;

(2) a plurality of spaced, parallel second recesses in said bottom surface;

(3) a plurality of first through-openings extending between said front and rear surfaces and communicating with said second recesses, respectively, the instrument strings passing through said first through-openings and said second recesses; and (4) a plurality of second through-openings extending between said first and second recesses; respectively;

(b) means for connecting said base with the guitar head portion;

(c) a plurality of clamping means arranged in said second recesses and said second through-openings, respectively, the portions of the instrument strings passing through said second recesses being arranged between said clamping means and said base; and (d) a plurality of wedge means arranged in said first recesses, respectively, for displacing said clamping means relative to said base to clamp and release the instrument string.

2. Apparatus as defined in claim 1, and further comprising means arranged in said first recesses and connected with said base for displacing said wedge means to operate said clamping means, respectively.

3. Apparatus as defined in claim 2, wherein each of said wedge means comprises a wedge member containing a through-opening aligned with one of said second through-openings.

4. Apparatus as defined in claim 3, wherein said clamping means each comprise (1) a clamping block arranged in each of said second recesses and containing a threaded opening aligned with one of said second through-openings; and (2) a screw having head and body portions, said screw body portion being arranged in said wedge opening and said body second opening and threadably connected with said clamping block threaded opening, said screw head portion being arranged above and having a diameter greater than the minimum diameter of said wedge opening, said screw being rotatable to vertically displace said clamping block relative to said base to accomodate strings of different diameters.

5. Apparatus as defined in claim 4, wherein said base first recesses are defined by bottom walls which are inclined from said rear surface toward said front surface, and further wherein said wedge members have inclined bottom surfaces corresponding to and in sliding engagement with said first recess bottom walls, respectively.

6. Apparatus as defined in claim 5, wherein said wedge displacing means comprise a plurality of levers having cam surfaces engaging said wedge members, respectively.

7. Apparatus as defined in claim 6, and wherein said levers are rotatably connected with said base.

8. Apparatus as defined in claim 7, wherein said base contains a plurality of aligned third through-openings adjacent said rear surface and extending normal to said first through-openings and said levers containing openings aligned with said base third through-openings, and further comprising a pin extending through said base third through-openings and said lever openings, said levers rotating about said pin.

9. Apparatus as defined in claim 8, wherein said lever openings define a horizontally and longitudinally offset pivot axis, said levers being rotated through and locked in an over-center position with said cam surfaces engaging said wedge members to clamp the instrument strings.

10. Apparatus as defined in claim 9, wherein each clamping block is operable to clamp two instrument strings.

* * * * *